United States Patent [19]

Chen

[11] Patent Number: 5,029,858

[45] Date of Patent: Jul. 9, 1991

[54] STRUCTURE OF A COMPOSITE FIBER RACKET

[76] Inventor: Dennis Chen, 9-1, Lane 161, Hsing An Road, Sec. 1, Taichung

[21] Appl. No.: 554,014

[22] Filed: Jul. 17, 1990

[51] Int. Cl.[5] ..... A63B 49/10

[52] U.S. Cl. ..... 273/73 F

[58] Field of Search ..... 273/73 R, 73 D, 73 F, 273/DIG. 7, DIG. 23

[56] References Cited

U.S. PATENT DOCUMENTS

| | | | |
|---|---|---|---|
| 3,770,033 | 11/1973 | Gavillet et al. | 273/73 F |
| 3,949,988 | 4/1976 | Staufer | 273/73 F |
| 4,212,461 | 7/1980 | Cecka | 273/73 F |
| 4,399,992 | 8/1983 | Molitor | 273/73 F |
| 4,684,131 | 8/1987 | Mortvedt | 273/73 F |
| 4,983,242 | 1/1991 | Reed | 273/73 F X |

FOREIGN PATENT DOCUMENTS

| | | | |
|---|---|---|---|
| 3541590 | 3/1987 | Fed. Rep. of Germany | 273/73 F |
| 2495477 | 6/1982 | France | 273/73 F |

*Primary Examiner*—Edward M. Coven
*Assistant Examiner*—William E. Stoll

[57] ABSTRACT

Disclosed is an improved structure of a composite fiber racket, which includes a frame comprising a head portion and a handle, wherein a catgut string is laterally and longitudinally inserted through the through-holes set around the head portion to form a taut striking surface, characterized by the head portion having thereon a plurality of reinforcement elements inset at several predetermined positions. Each of the reinforcement elements has an elongate foam piece disposed therein and is covered with a layer of composite fiber which is of the same material as used by the head portion. One side of the reinforcement element is attached to the corresponding inner side wall of the head portion, and the other side thereof has a small space separating it from the corresponding outer side wall of the head portion, so as to reinforce the strength of the head portion and increase the weight distribution around the periphery of the racket frame.

1 Claim, 3 Drawing Sheets

1–1

3–3

2–2

STRUCTURE OF A COMPOSITE FIBER RACKET

BACKGROUND OF THE INVENTION

The present invention relates to a racket structure and more particularly to an improved structure of a composite fiber racquet.

According to the manufacturing of composite fiber rackets as adopted in the prior art, a polyethylene tube, of oblate form, is generally covered with a layer of fiber, then put into a molding die with an opening through which high-pressure heated air from a pump is blown in to complete the molding process. Alternately, the polyethylene tube can be filled with expandable polyurethane to form the tube within the mold.

A major deficiency of these methods is that when the polyethylene tube is placed in the mold the inner side thereof tends to wrinkle upon bending. Making it impossible to keep the thickness of the fiber layer even. Consequently, at the positions of the through-holes, after the head frame is strung, cracks tend to occur due to the stress concentrations from the taut strings. Thus the wrinkling of the inner side not only degrades the appearance of the racquet but also reduces the service life of the head frame.

SUMMARY OF THE PRESENT INVENTION

The present invention has been accomplished under the circumstances in view. It is the main object of the present invention to provide an improved structure of a composite fiber racket which can considerably reinforce the strength of the head portion and increase the weight around the periphery of the racket frame.

It is another object of the present invention to provide an improved structure of a composite fiber racket which ca significantly reduce the possibility that, upon forming in a mold, the inner side wall of the head frame will wrinkle, and thus prolong the service life of the racket by the strengthening of this portion.

According to the present invention, an improved structure of composite fiber racket includes a frame comprising a head portion and a handle, wherein a catgut string is laterally and longitudinally inserted through the through-holes set around the head portion to form a taut striking surface, characterized in that the head portion has thereon a plurality of reinforced elements inset at predetermined points. Each of the reinforced elements has an elongate foam piece therein and is covered with a layer of composite fiber which is of the same material as used in the head frame. One side of each reinforced element is integrated with the corresponding inner side wall of the head frame, with the other side spaced apart from the corresponding outer wall. This serves to reinforce the strength and increase the weight of the head frame.

BRIEF DESCRIPTION OF THE DRAWINGS

The present invention will now be described by way of example with reference to the accompanying drawings, in which.

DETAILED DESCRIPTION OF THE PREFERRED EMBODIMENT

Figure 1:
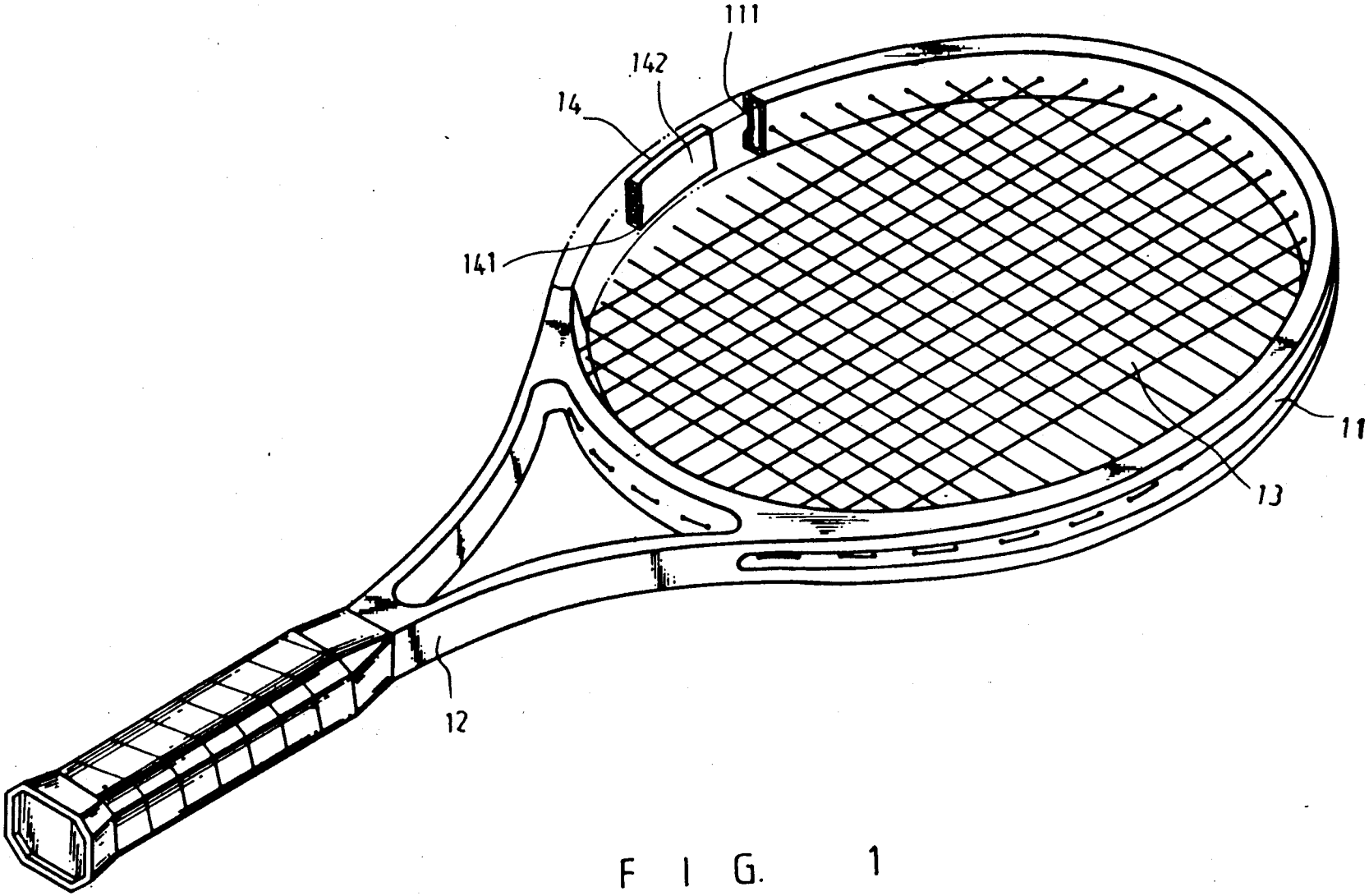
FIG. 1 is a perspective cut-away view of the present invention.

FIG. 1 shows an improved structure of a composite fiber racket, which includes a frame 10 generally comprising of a head portion 11 and a handle 12, wherein a catgut string is laterally and longitudinally inserted through the through-holes set around the circumference of the head portion 11 to form a tensioned striking surface. As the shape of the racquet of the present invention is similar with that of conventional racquets, no further description will be detailed hereinafter. Where the present invention is most distinguishable from the conventional racquets is shown in the dotted line section of FIG. 2. As can be seen, the head portion 11 has thereon a plurality of reinforcement elements 14, disposed orthogonally on the crown, opposite shoulders, and throat area of the head frame.

Figure 3:
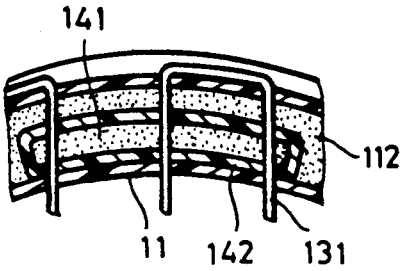
FIG. 3 is a cross-sectional view of the head frame structure taken on line 1—1 of FIG. 2.

As illustrated in the FIG. 3, each reinforcement element 14 includes an elongated foam element 141 of pre-determined length, which in the present embodiment is formed from polyurethane foam because of its excellent shock absorbing qualities. The elongate foam element 141 is covered with a layer of composite fiber 142 of a pre-determined thickness, which uses the same carbon fiber as used by the head portion 11. One side of the reinforcement element 14 adheres flush with the corresponding inner side wall of the head portion 11, and the other side thereof maintains a space 111 away from the corresponding outer side wall of the head portion 11, as shown in FIG. 4A.

Figure 2:
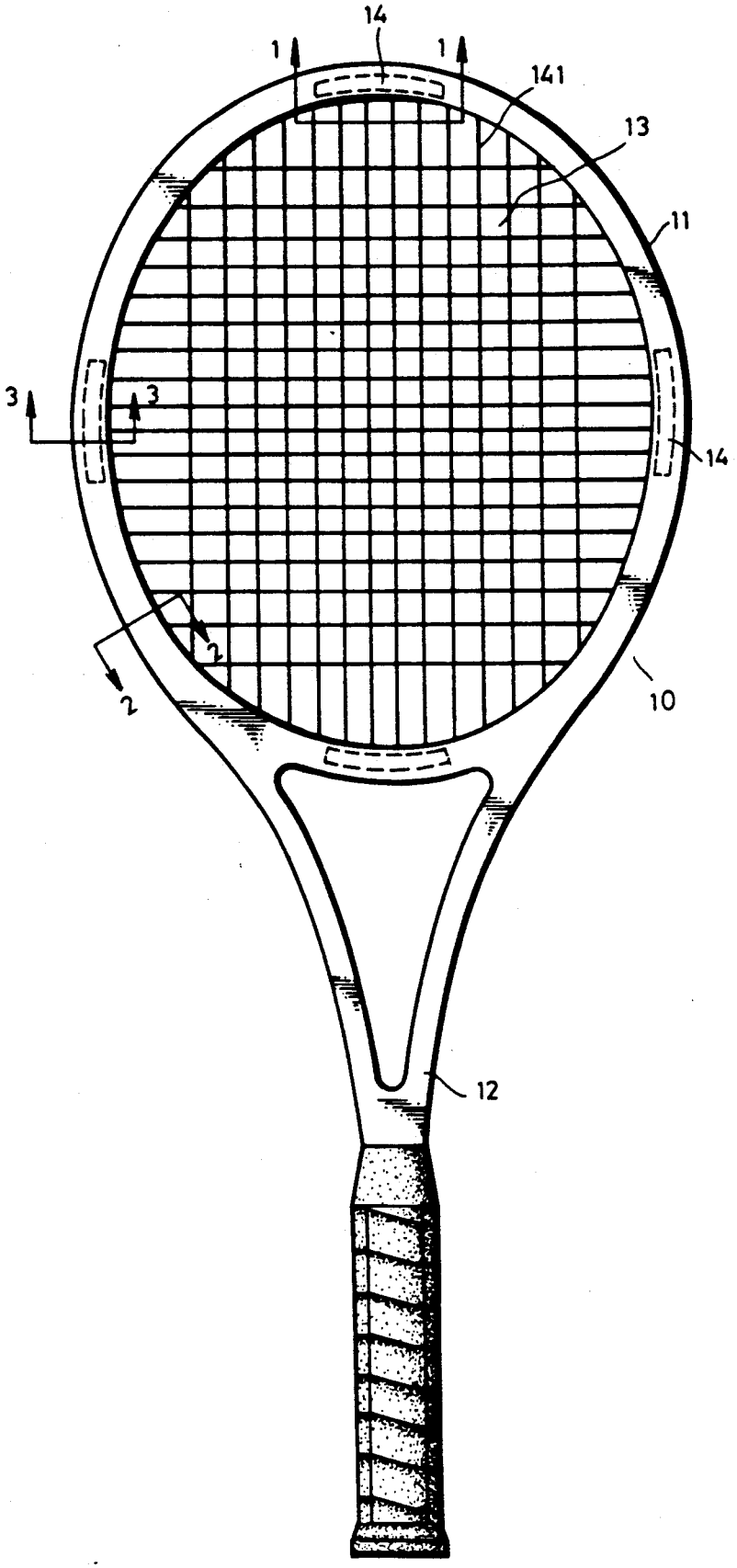
FIG. 2 is a frontal view illustrating the present invention.

Once again referring to FIGS. 1 and 2, each preformed elongate foam member 1414 is covered with a layer of composite fiber 142 of a pre-determined thickness to become a reinforcement element 14 which, in turn, is placed into a polyethylene pipe at pre-determined locations corresponding to the orthogonally disposed positions previously mentioned. The reinforcement element 14 can be positioned adjacent to the inner side wall as shown in the cross-sectional view of FIG. 4B or, alternately, adjacent to the outer wall as in FIG. 4C. The polyethylene pipe is subsequently covered with a layer of carbon fiber in such manner as to form an elongate oblate tube. The assembly is then placed in a mold, not shown, which has an opening through which high pressure and high temperature gas enters to complete the molding process. Alternately, expandable polyurethane foam can be inserted into the polyethylene pipe to form the head frame. As illustrated in FIGS. 1 and 2, the reinforcement elements 14, upon the molding process, assume the orthogonally opposed positions described above. These positions correspond to the rear of the head frame portion 11 that are most inclined to wrinkle during molding. Thus, the reinforcement elements would serve to prevent this from occurring.

Figure 4A:
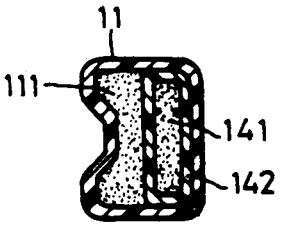
FIG. 4A is a cross-sectional view of the head frame structure taken along line 3—3 of FIG. 2.
Figure 4B:
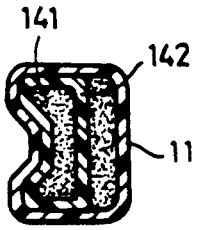
FIG. 4B is a cross-sectional view of an alternate arrangement of the reinforcement element in FIG. 4B.
Figure 4:
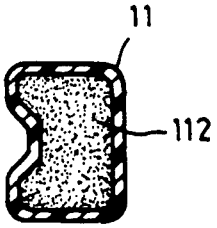
FIG. 4 is a cross-sectional view of the head frame structure taken along line 2—2 of FIG. 2.

Furthermore, as shown in FIG. 4B, a double-tube section is formed by the insetting of reinforcement element 14, so that the axial areas by 141 and 142 are increased, and in this case, the reinforcement element 14 will have lozenge strength in the direction of a vertical axial plane, parallel to that of a striking ball. As a result, the rebounding qualities of the racquet is improved.

Moreover, as illustrated in FIGS. 3, 4A, and 4B, the reinforcement elements 14 is covered with a layer of carbon fiber 142, which is the same material as used in the head portion 11, so that the reinforcement elements 14 and the inner side wall of the head portion 11 are fused together during the molding process. The space 111 between the reinforcement elements 14 and the outer side wall of the head portion 11 is filled with polyurethane foam, as are the gaps 112 between adjacent reinforcement elements 14.

Consequently, when the taut strings 131 are inserted through the through-holes of the head portion 11, the strings 131 are firmly supported by the inner and outer walls of the head frame portion 11, the reinforcement elements 14, and the interspersed polyurethane foam, which acts to absorb shock otherwise transmitted to the frame generated when a ball is struck. Also, as the stress concentration, is greatest at the inner wall of the head frame portion 11, the reinforcement elements 14 serve to increase the racquets resistance to cracking and breakage, prolonging its service life. Furthermore, the weight distribution around the periphery of the racquet head is increased, so as to offer better handling to the user.

I claim:

1. An improved structure of a composite fiber racket which includes a frame comprising a head portion and a handle, wherein a catgut string is laterally and longitudinally inserted through the through-holes disposed around the periphery of said head portion to form a taut striking surface, wherein said head portion has thereon a plurality of reinforcement elements disposed at predetermined positions, each of said reinforcement elements comprises an elongate foam element covered with a layer of composite fiber which is the same material as used in said head portion, one side of said reinforcement element is attached to the corresponding inner side wall of said head portion, and the other side thereof is separated by a space from the corresponding outer side wall of said head portion, whereby the strength of said head portion is increased as is the weight distribution around the periphery of the racket frame.

* * * * *